US009475665B2

(12) United States Patent
Tanaka

(10) Patent No.: US 9,475,665 B2
(45) Date of Patent: Oct. 25, 2016

(54) PAPER ROLL HOLDING STRUCTURE AND PRINTER

(75) Inventor: Takuya Tanaka, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 342 days.

(21) Appl. No.: 13/447,564

(22) Filed: Apr. 16, 2012

(65) Prior Publication Data

US 2013/0270386 A1 Oct. 17, 2013

(51) Int. Cl.
*B65H 75/24* (2006.01)
*B65H 19/12* (2006.01)

(52) U.S. Cl.
CPC ... *B65H 19/126* (2013.01); *B65H 2301/41346* (2013.01); *B65H 2403/411* (2013.01); *B65H 2801/12* (2013.01)

(58) Field of Classification Search
CPC ..... B65H 19/126
USPC ..... 242/596, 596.4, 596.5, 596.6, 596.7, 242/596.8, 578, 578.1
See application file for complete search history.

(56) References Cited

U.S. PATENT DOCUMENTS 2,948,486 A * 8/1960 Epeneter ..... 242/596.4
4,520,968 A * 6/1985 Shpigelman ..... 242/560.3
4,553,710 A * 11/1985 Pool ..... A47K 10/40 242/596.4
4,662,576 A * 5/1987 Paul ..... 242/596.4
5,000,393 A * 3/1991 Madsen ..... A47K 10/38 221/297
6,276,629 B1 * 8/2001 Laporte ..... 242/596.3
6,286,781 B1 * 9/2001 Lai ..... 242/596.4
6,431,492 B1 * 8/2002 Chillscyzn ..... 242/577
6,503,008 B2 * 1/2003 Zevin et al. ..... 400/613
7,802,750 B2 * 9/2010 Takeuchi ..... 242/596.4
8,500,058 B2 * 8/2013 Lan ..... 242/578
2003/0189126 A1 * 10/2003 Hale ..... 242/596.4
2008/0283658 A1 * 11/2008 Reilly ..... 242/596.4

FOREIGN PATENT DOCUMENTS

JP 2002-087652 3/2002

* cited by examiner

*Primary Examiner* — Emmanuel M Marcelo
*Assistant Examiner* — Justin Stefanon
(74) *Attorney, Agent, or Firm* — Amin, Turocy & Watson LLP

(57) ABSTRACT

A paper roll holding structure for use in a printer includes two side plates to guide a paper roll. Each side plate has a guide surface opposing an opposite side surface of the paper roll. Holding members are arranged in the paper roll holding structure to hold the paper roll. Each holding member has a first end to be inserted into an axial hole of the paper roll and a second end formed at the opposite side of the first end. Also, support members are arranged on the guide surfaces of the side plates to restrain the holding members from moving downwards from a substantially vertical position. The support members are further configured to support the second ends of the holding members in such a manner as to allow the holding members to swing upwards.

6 Claims, 6 Drawing Sheets

PAPER ROLL HOLDING STRUCTURE AND PRINTER

FIELD

Embodiments described herein relate generally to a paper roll holding structure and a printer.

BACKGROUND

There is conventionally known a printer for holding a paper roll formed by winding an elongated paper and printing on the paper supplied from such a paper roll.

In this type of the printer, there is a need to provide a structure and method for loading and holding the paper roll in an easy and stable manner.

DETAILED DESCRIPTION

According to one embodiment, a paper roll holding structure includes two side plates configured to guide a paper roll formed by winding a paper, each of the side plates having a guide surface opposing an opposite side surface of the paper roll. The paper roll holding structure also includes holding members configured to hold the paper roll, each of the holding members having a first end fitted to an axial hole of the paper roll and a second end formed at the opposite side of the first end. Support members are arranged on the guide surfaces of the side plates to restrain the holding members from moving downwards from a position where the holding members are kept substantially horizontal, the support members configured to support the second ends of the holding members in such a manner as to allow the holding members to swing upwards.

A paper roll holding structure and a printer according to some embodiments will now be described in detail with reference to the accompanying drawings. The following description is directed to an application of the embodiments to a thermal printer configured to convey a paper from a paper roll held by a paper roll holding structure and print on the paper thus conveyed.

Figure 1:
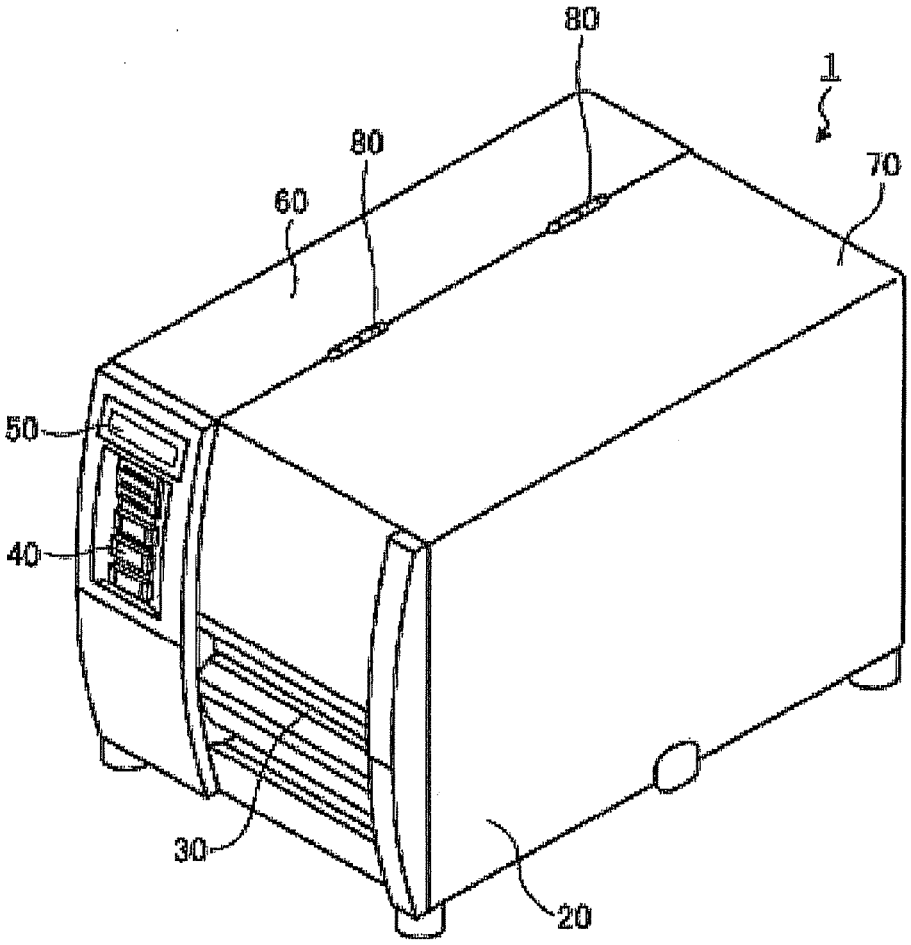
FIG. 1 is a perspective view schematically showing an exterior configuration of a printer according to one embodiment.

FIG. 1 is a perspective view schematically showing an external configuration of a printer 1 according to one embodiment. As shown in FIG. 1, a paper outlet 30 through which a printed paper can be discharged is formed on the front surface of a housing 20 of the printer 1. On the left surface of the housing 20, there is provided a control box 60 that includes different types of operation keys 40 and a display unit 50 such as a liquid crystal display, which are arranged on the front surface of the control box 60. In the control box 60, a control unit (not shown) is provided for controlling the operations of individual units of the printer 1. A cover 70 is attached to the housing 20 so that the cover 70 can rotate upwards about a hinge 80 extending along one edge of the upper surface of the housing 20 near the control box 60. A user can access the internal configuration arranged within the housing 20 by rotating the cover 70 upwards.

Figure 2:
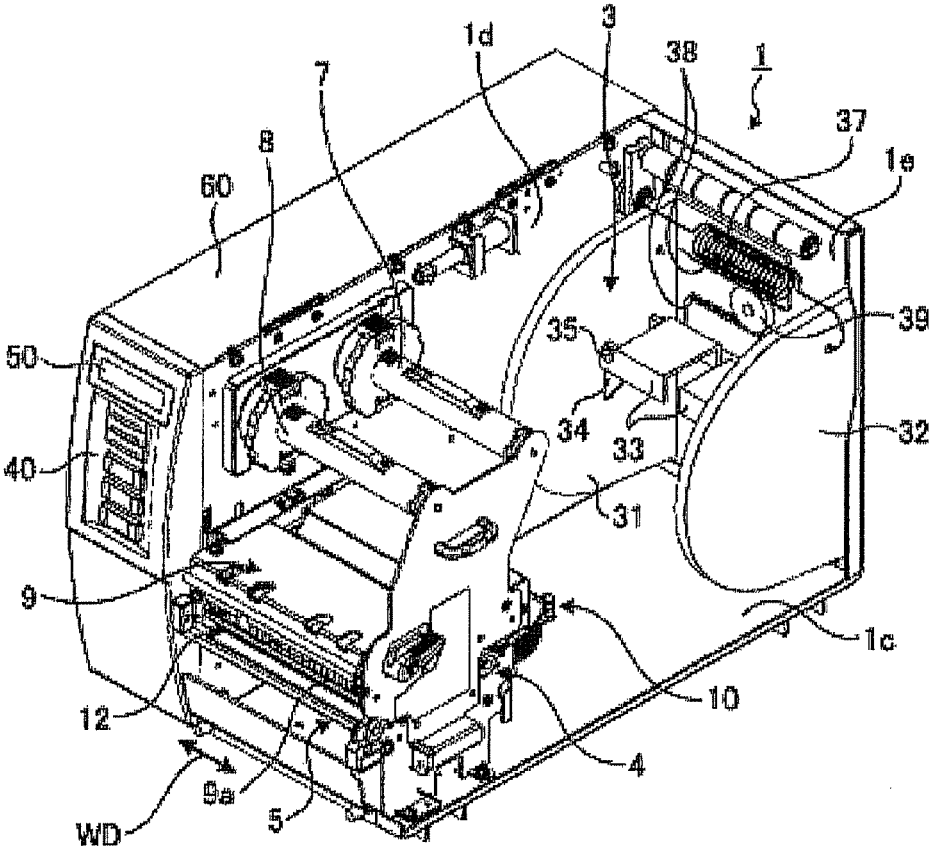
FIG. 2 is a perspective view illustrating one example of an internal configuration of the printer.

FIG. 2 is a perspective view illustrating one example of an internal configuration of the printer 1. More specifically, FIG. 2 shows the internal configuration of the printer 1, in which the cover 70 is opened and an ink ribbon and a paper roll 100 (see, e.g., FIG. 5) are not mounted yet.

As shown in FIG. 2, the printer 1 includes a bottom wall 1*c*, a vertical wall 1*d* perpendicular to the bottom wall 1*c* and parallel to the side wall of the cover 70 when the cover 70 is kept closed, and a rear wall 1*e* perpendicular to the vertical wall 1*d* and the bottom wall 1*c*. A conveying roller 4, a platen roller 5, a supply shaft 7, a take-up shaft 8, a printing block 9 and a pinch roller block 10 are attached to the vertical wall 1*d* in a substantially perpendicular relationship with the vertical wall 1*d*. A paper roll holder 3 is attached to the rear wall 1*e*. The paper roll holder 3 includes paper roll guide plates 31 and 32 extending parallel to the vertical wall 1*d* and located opposite each other in the width direction WD.

Figure 6:
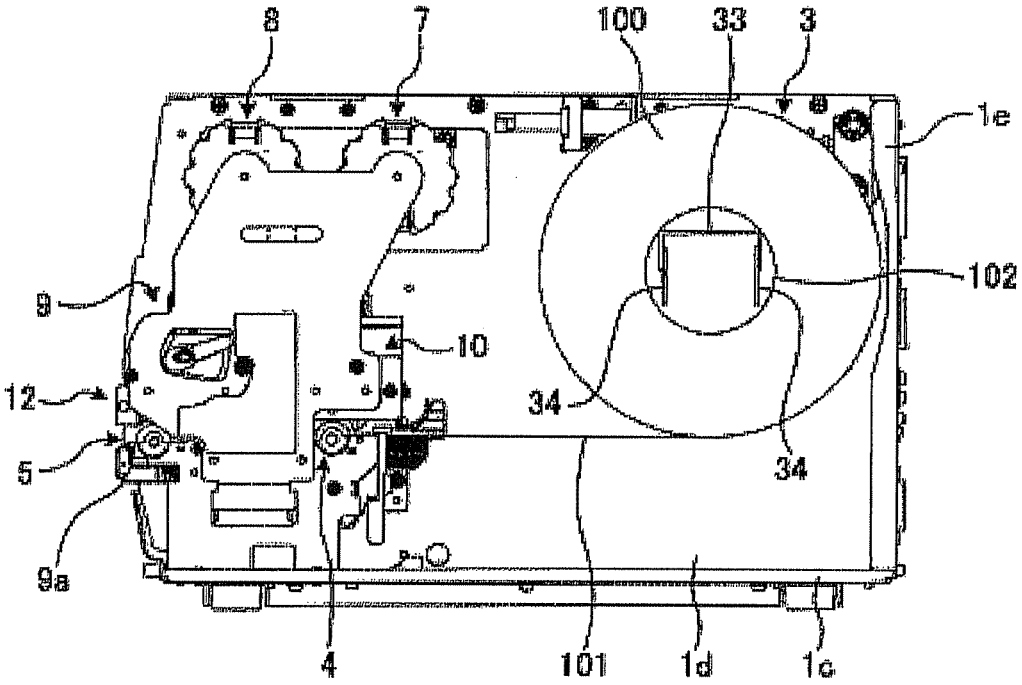
FIG. 6 is a side view showing one example of the internal structure of the printer.

The paper roll holder 3 serves as a paper roll holding structure for holding the paper roll 100 formed by winding a paper 101 (see FIG. 6). The paper roll holder 3 includes paper roll guide plates 31 and 32 configured to guide the paper roll 100 at the side surfaces of the paper roll 100. In the paper roll holder 3, holding members 33 are arranged to hold the paper roll 100 with the end portions thereof fitted to an axial hole 102 of the paper roll 100. Also, the paper roll holder 3 includes support members 34 configured to support the holding members 33.

Figure 3:
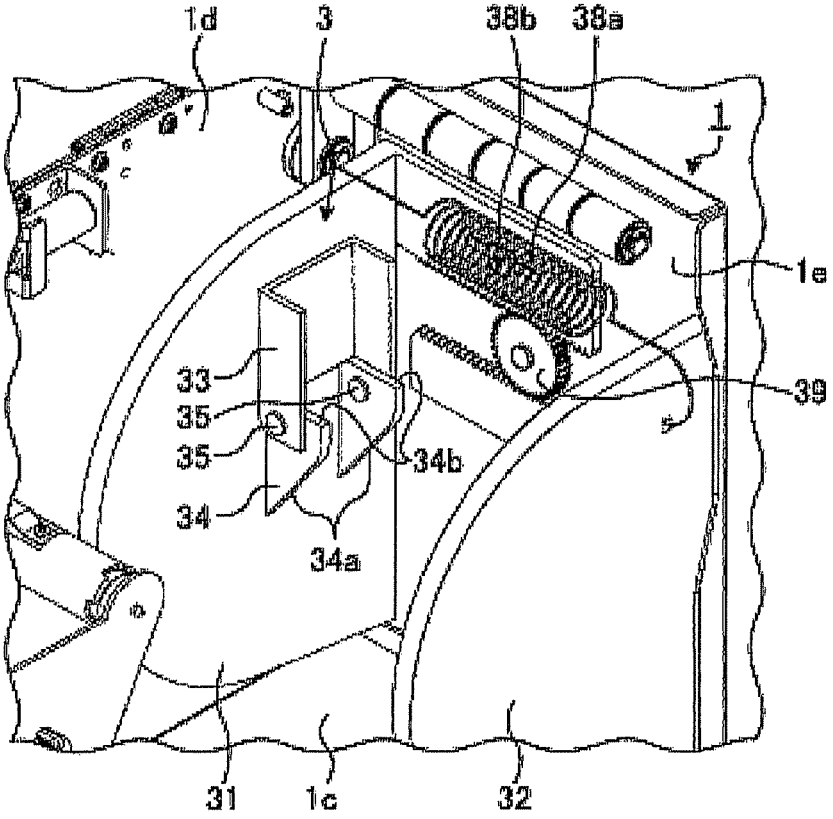
FIG. 3 is a perspective view illustrating one example of a structure around a paper roll holder.

FIG. 3 is a perspective view illustrating one example of a structure around the paper roll holder 3. As shown in FIGS. 2 and 3, one of the support members 34 is installed on the surface of the paper roll guide plate 31 for guiding the paper roll 100 (i.e., on the surface of the paper roll guide plate 31 opposite the paper roll guide plate 32). Although not specifically shown in the drawings, similar to the paper roll guide plate 31, the other support member 34 is installed on the surface of the paper roll guide plate 32 for guiding the paper roll 100 (i.e., on the surface of the paper roll guide plate 32 opposite the paper roll guide plate 31). For the sake of explanation, only the paper roll guide plate 31 will be described in detail below because the paper roll guide plate 32 has a similar configuration to the paper roll guide plate 31.

One end portion of the holding member 33 is supported on the support member 34 by a pivot shaft 35. The pivot shaft 35 rotatably supports the holding member 33 at the upper side of the support member 34 so that the holding member 33 can pivot vertically upwards. In other words, the holding member 33 is configured to swing upwards so that the end portion of the holding member 33 to be fitted to the axial hole 102 of the paper roll 100 (i.e., one end portion of the holding member 33 opposite the other end portion thereof supported by the pivot shaft 35) faces vertically upwards.

The support member 34 includes paper roll guide portions 34*a* formed in the lower portion thereof. Each of the paper roll guide portions 34*a* has a slant surface configured to gradually extend away from the paper roll guide plate 31 in a direction perpendicular to the paper roll guide plate 31 (i.e., width direction WD) as the slant surface extends from the vertical lower end toward the vertical upper end thereof.

Accordingly, the paper roll guide portions 34*a* make contact with the edge of the paper roll 100 when the paper roll 100 guided between the paper roll guide plates 31 and 32 is pushed upwards. Thus, when the paper roll 100 is pushed upwards between the paper roll guide plates 31 and 32, a wider space is formed between the paper roll guide plates 31 and 32, which can be slid in the width direction WD by a slide mechanism to be described below.

The support member 34 includes horizontal extension portions 34*b* formed in the upper area thereof. If the holding member 33 rotatably supported on the upper portion of the support member 34 by the pivot shaft 35 pivots to have a substantially horizontal position, the lower surface of the holding member 33 makes contact with the horizontal extension portions 34*b* of the support member 34. Therefore, the horizontal extension portions 34*b* restrain the holding member 33 from moving further downwards from the substantially horizontal position. This ensures that, when the holding members 33 are fitted to the axial hole 102 of the paper roll 100, the paper roll 100 is restrained from moving downwards by the weight of the paper roll 100 and is kept in a stable state.

Rack gears 38 are coupled to the paper roll guide plates 31 and 32. The rack gears 38 extend from the paper roll guide plates 31 and 32 in a direction perpendicular to the paper roll guide plates 31 and 32 and are parallel with the rear wall 1*e*. The rack gears 38 are configured to make sliding movement in the width direction WD. The rack gears 38 may also be integrally formed with the paper roll guide plates 31 and 32. Each of the rack gears 38 has a slide slot 38*a* and is attached to the rear wall 1*e* by a fastener 38*b* inserted into the slide slot 38*a*. The rack gears 38 coupled to the paper roll guide plates 31 and 32 engage with a pinion gear 39 interposed therebetween and can make sliding movement in the width direction WD with respect to the pinion gear 39. By the sliding movement of the rack gears 38 in conjunction with the pinion gear 39, which make up a slide mechanism, the paper roll guide plates 31 and 32 can be slid in the width direction WD while being spaced equally with respect to a center point (e.g., the pinion gear 39).

A spring 37 having a biasing force for pulling the paper roll guide plate 32 toward the paper roll guide plate 31 in the width direction WD is attached to the paper roll guide plate 32. The biasing force is transmitted to the paper roll guide plate 31 through the rack gears 38 and the pinion gear 39, thereby pulling the paper roll guide plate 31 toward the paper roll guide plate 32. In other words, the spring 37 is a biasing member for biasing the paper roll guide plates 31 and 32 toward each other. The spring 37 is provided as the biasing member by way of example, and the type and attachment method of the biasing member may not be particularly limited thereto.

As shown in FIG. 2, the conveying roller 4, the platen roller 5, the supply shaft 7, the take-up shaft 8, the printing block 9 and the pinch roller block 10 are arranged such that enough space to accommodate the paper roll 100 is formed between the paper roll holder 3 and the conveying roller 4, the supply shaft 7 and the pinch roller block 10. The conveying roller 4 and the platen roller 5 are rotationally driven by motors (not shown). The conveying roller 4 is arranged at the upstream side of the printing unit 12 and the platen roller 5. The pinch roller block 10 includes a pinch roller (not shown) arranged above and near the conveying roller 4 parallel with the conveying roller 4. The pinch roller is biased toward the conveying roller 4 by a biasing member with an appropriate biasing force. The paper 101 (see FIG. 6) drawn from the paper roll 100 is interposed by the conveying roller 4 and the pinch roller and is conveyed by the rotation of the conveying roller 4. In the present embodiment, the conveying roller 4, the platen roller 5, the motor (not shown), the motor controller (not shown) and the pinch roller block 10 make up a conveying mechanism.

A ribbon roll (not shown) formed by winding an ink ribbon is loaded around the ink ribbon supply shaft 7. By rotating the take-up shaft 8 driven by a motor, the ink ribbon is wound around the take-up shaft 8 and is drawn from the ribbon roll. The ink ribbon and the paper 101 are interposed between the thermal head 9*a* of the printing block 9 and the platen roller 5. The ink of the ink ribbon is melted or sublimed as the thermal head 9*a* is heated. As a result, specified patterns (e.g., letters, numerals, barcodes or diagrams) are transferred to the surface of the paper 101. In the present embodiment, the ink ribbon, the supply shaft 7, the take-up shaft 8, the printing block 9, the thermal head 9*a*, the motors (not shown) and the motor controller (not shown) make up a printing mechanism. The thermal head 9*a* and the platen roller 5 make up a printing unit 12.

Figure 4:
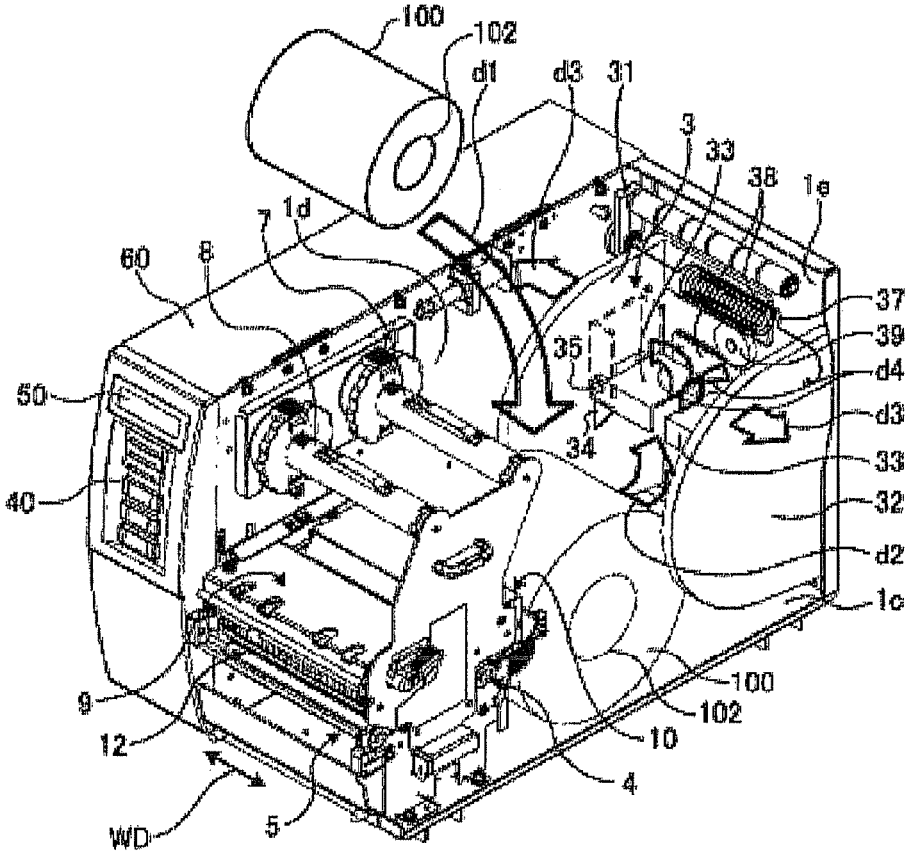
FIG. 4 is a perspective view illustrating one example of an operation of loading the paper roll into the paper roll holder.
Figure 5:
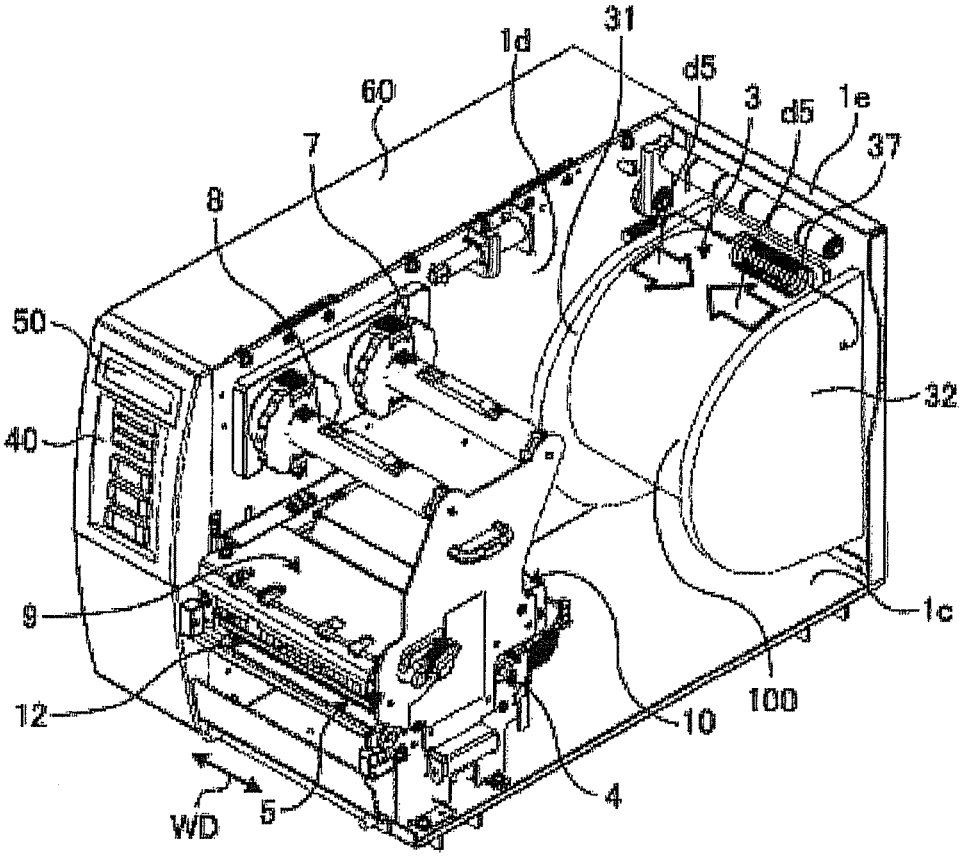
FIG. 5 is a perspective view illustrating another example of the operation of loading the paper roll into the paper roll holder.

The following is a description on how to load the paper roll 100 into the paper roll holder 3. FIGS. 4 and 5 are perspective views illustrating examples of an operation of loading the paper roll 100 into the paper roll holder 3.

Referring to FIG. 4, to load the paper roll 100 into the paper roll holder 3, the user moves the paper roll 100 down along the vertical wall 1*d* from above the printer 1 in a direction dl. The user continues to put the paper roll 100 into the space formed between the paper roll holder 3 and the conveying roller 4, the supply shaft 7 and the pinch roller block 10. Then, the user moves the paper roll 100 upwards in a direction d2 toward a space between the paper roll guide plates 31 and 32. At this time, the edges of the paper roll 100 come into contact with the paper roll guide portions 34*a* formed in the lower area of the support members 34, thereby allowing the paper roll guide plates 31 and 32 to move away from each other in a direction d3. Subsequently, the edges of the paper roll 100 make contact with the lower surface of the holding members 33, thereby causing the holding members 33 to pivot upwards about the pivot shaft 35. As a result, the holding members 33 are arranged to have a substantially vertical position as outlined by the dotted line in FIG. 4. However, in actuality, the holding members 33 may not be arranged vertically, but may have a slanted position with respect to the paper roll guide plate 31.

Thereafter, the user moves the paper roll 100 down from a position where the end portions of the upward arranged holding members 33 enter the axial hole 102 of the paper roll 100. Since the paper roll guide plates 31 and 32 are kept pushed away from each other by the paper roll 100, the end portions of the holding members 33 can be readily inserted into the axial hole 102 of the paper roll 100. The holding members 33 inserted into the axial hole 102 of the paper roll 100 are then swung into a substantially horizontal position. In this state, the horizontal extension portions 34*b* of the support members 34 restrain the paper roll 100 from moving further downwards. The operation of loading the paper roll 100 is completed when the holding members 33 are inserted into the axial hole 102 of the paper roll 100 and are kept in the substantially horizontal position.

In this manner, the user can easily load the paper roll 100 into the printer 1 without having to perform a time-consuming laborious operation such as separating the paper roll guide plates 31 and 32 from the printer 1. Referring to FIG. 5, the paper roll guide plates 31 and 32 are biased toward each other by the spring 37 in a direction d5 to reduce the gap between the paper roll guide plates 31 and 32. By the rack-and-pinion mechanism including the rack gears 38 and the pinion gear 39, the paper roll guide plates 31 and 32 can be slid in the width direction WD with respect to a center point, e.g., the pinion gear 39. Accordingly, the paper roll 100 loaded between the paper roll guide plates 31 and 32 is centrally aligned in the width direction WD and is held in a stable condition.

Referring now to FIG. 6, description will be made on how the holding member 33 is inserted into the axial hole 102 of the paper roll 100. FIG. 6 is a side view showing one example of the internal structure of the printer 1. More specifically, FIG. 6 is a side view of the internal structure of the printer 1 seen from the side of the paper roll guide plate 32, where the paper roll guide plate 32 is separated from the paper roll holder 33 with the paper roll 100 loaded therein.

As shown in FIG. 6, when inserted into the axial hole 102 of the paper roll 100, the holding member 33 holds the paper roll 100 by making contact with the inner circumferential surface (defining the axial hole 102) of the paper roll 100 at two points of the corner areas thereof. Since the inner circumferential surface of the paper roll 100 and the holding member 33 make contact with each other at at least two points in this manner, it is possible to prevent the paper roll 100 from rolling like a pendulum in the direction in which the paper 101 is drawn by the conveying roller 4 and the pinch roller. While the present embodiment has been described by taking as an example a configuration in which the holding member 33 makes contact with the inner circumferential surface (defining the axial hole 102) of the paper roll 100 at two points of the corner areas thereof, other layouts may be adopted as long as the holding member 33 makes contact with the inner circumferential surface of the paper roll 100 at at least two points. The corner areas of the holding member 33 may have a round shape conforming to the shape of the inner circumferential surface of the paper roll 100.

While the embodiment described above is directed to the paper roll holder 3 in which both of the paper roll guide plates 31 and 32 move away from each other in the width direction WD when the paper roll 100 is loaded, the present disclosure is not limited thereto. Alternatively, only one of the paper roll guide plates 31 and 32 (e.g., paper roll guide plate 32) may be configured to move away from the other in the width direction WD when the paper roll 100 is loaded. In this case, the slide mechanism may be configured to slide the paper roll guide plate 32 in a horizontal direction without the pinion gear 39.

While certain embodiments have been described, these embodiments have been presented by way of example only, and are not intended to limit the scope of the inventions. Indeed, the novel paper roll holding structure and printer described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A paper roll holding structure, comprising:

two side plates configured to guide a paper roll formed by winding a paper, each side plate having a guide surface opposing an opposite side surface of the paper roll;

holding members configured to hold the paper roll, each holding member having a first end being capable of being inserted into an axial hole of the paper roll and a second end formed at the opposite side of the first end;

support members arranged on the guide surfaces of the side plates to block the holding members from moving downwards from a substantially horizontal position when the first end of each holding member is inserted into the axial hole of the paper roll, the support members having pivot shafts configured to rotatably support the second ends of the holding members in such a manner as to allow the holding members to swing upwards, wherein the support member includes a paper roll guide portion having a slant surface configured to make contact with edges of the paper roll when the paper roll is pushed upwards and formed in a lower portion of the support member, wherein the slant surface is configured to gradually extend away from the side plate in a direction perpendicular to the side plate as the paper roll guide portion extends from a vertical lower end of the slant surface toward a vertical upper end of the slant surface, and wherein the holding members are configured to hold the paper roll by making contact along at least two lines when the holding member are inserted into the axial hole of the paper roll.

2. The structure of claim 1, further comprising:

a slide mechanism configured to allow the side plates to slide toward or away from each other in a width direction of the paper roll; and a biasing member configured to bias the side plates toward each other, wherein when the paper roll is pushed upwards from below the support members, the paper roll guide portion causes the side plates to move away from each other.

3. The structure of claim 1, further comprising:

a slide mechanism configured to allow one of the side plates to slide toward or away from the other side plate in a width direction of the paper roll; and a biasing member configured to bias the one of the side plates toward the other, wherein when the paper roll is pushed upwards from below the support members, the paper roll guide portion causes one of the side plates to move away from the other.

4. A printer, comprising:

two side plates configured to guide a paper roll formed by winding a paper, each side plate having a guide surface opposing an opposite side surface of the paper roll;

holding members configured to hold the paper roll, each holding member having a first end being capable of being inserted into an axial hole of the paper roll and a second end formed at the opposite side of the first end;

support members arranged on the guide surfaces of the side plates to block the holding members from moving downwards from a substantially horizontal position when the first end of each holding member is inserted into the axial hole of the paper roll, the support members having pivot shafts configured to rotatably support the second ends of the holding members in such a manner as to allow the holding members to swing upwards;

a conveying mechanism configured to convey the paper drawn from the paper roll held by the holding members; and a printing mechanism configured to perform printing on the paper conveyed by the conveying mechanism, wherein the support member includes a paper roll guide portion having a slant surface configured to make contact with edges of the paper roll when the paper roll is pushed upwards and formed in a lower portion of the support member, wherein the slant surface is configured to gradually extend away from the side plate in a direction perpendicular to the side plate as the paper roll guide portion extends from a vertical lower end of the slant surface toward a vertical upper end of the slant surface, and wherein the holding members are configured to hold the paper roll by making contact along at least two lines when the holding members are inserted into the axial hole of the paper roll.

5. The printer of claim 4, further comprising:

a slide mechanism configured to allow the side plates to slide toward or away from each other in a width direction of the paper roll; and a biasing member configured to bias the side plates toward each other, wherein when the paper roll is pushed upwards from below the support members, the paper roll guide portion causes the side plates to move away from each other.

6. The printer of claim 4, further comprising:

a slide mechanism configured to allow one of the side plates to slide toward or away from the other side plate in a width direction of the paper roll; and a biasing member configured to bias one of the side plates toward the other, wherein when the paper roll is pushed upwards from below the support members, the paper roll guide portion causes one of the side plates to move away from the other.

* * * * *